US005671811A

United States Patent [19]

Head

[11] Patent Number: 5,671,811

[45] Date of Patent: Sep. 30, 1997

[54] TUBE ASSEMBLY FOR SERVICING A WELL HEAD AND HAVING AN INNER COIL TUBING INJECTED INTO AN OUTER COILED TUBING

[76] Inventor: Philip Head, 6 Leith Mansions, Grantully Road, London W9 1LQ, Great Britain

[21] Appl. No.: 588,200

[22] Filed: Jan. 18, 1996

[30] Foreign Application Priority Data

Jan. 18, 1995 [GB] United Kingdom ..... 9500954

[51] Int. Cl.[6] ..... E21B 19/09; E21B 19/22

[52] U.S. Cl. ..... 166/346; 166/77.2; 166/350; 166/367; 242/388.6

[58] Field of Search ..... 166/77.1, 77.2, 166/77.3, 355, 352, 367, 359, 350, 346, 345; 242/388.6, 388

[56] References Cited

U.S. PATENT DOCUMENTS

| | | | |
|---|---|---|---|
| 1,914,654 | 6/1933 | Tornblom | 242/388 |
| 3,346,045 | 10/1967 | Knapp et al. | 166/350 |
| 3,401,749 | 9/1968 | Daniel | 166/77.2 |
| 3,766,996 | 10/1973 | Moody et al. | 137/355.17 |
| 3,958,594 | 5/1976 | Masters | 137/335.17 |
| 4,240,506 | 12/1980 | Dareing | 166/367 |
| 4,850,440 | 7/1989 | Smet | 157/67 |
| 4,915,416 | 4/1990 | Barrett et al. | 166/359 |
| 5,429,194 | 7/1995 | Nice | 166/77.2 |

*Primary Examiner*—Hoang C. Dang
*Attorney, Agent, or Firm*—Herbert Dubno

[57] ABSTRACT

A tube assembly for servicing a well head injects an inner continuous coil tubing into an outer continuous coil tubing which can be connected at one end to a well head of an oil or gas reservoir. The inner coiled tubing can be connected to a tool string for servicing the well.

11 Claims, 8 Drawing Sheets

TUBE ASSEMBLY FOR SERVICING A WELL HEAD AND HAVING AN INNER COIL TUBING INJECTED INTO AN OUTER COILED TUBING

FIELD OF THE INVENTION

This invention relates to accessing a subsea oil production well or other such remote facilities. Such access is required for a number of reasons, for example, to take measurements of the reservoir by introducing logging devices, for servicing or installation of electric submersible pumps to enhance production rates and for many other reasons.

BACKGROUND OF THE INVENTION

Typically for a subsea production well the original drilling platform will have been removed and the well head will have to accessed by means of a suitable surface vessel. In order that the required operations can be carried out at the well it is necessary that the movement of the vessel which is floating on the surface of the sea be compensated to ensure positional consistency with respect to the well itself which is fixed on the sea bed. This is conventionally provided by means of a heave compensation system on the vessel itself which is extremely cumbersome and expensive.

Traditionally the outer tubing for intervention purposes has been typically 7 inches in diameter when it is necessary to carry out operations which require tool strings and other equipment which necessarily have a diameter of typically 7 inches. This outer tubing is called a riser and is conventionally made of jointed sections. Coiled tubing on the other hand is only available at an economic cost at a maximum diameter of 4.5 inches and it has therefore not been possible to use continuous coiled tubing as the riser because it was of an insufficient diameter to contain the tool string and equipment and therefore carry out well intervention operations which require the use of tool strings and equipment having diameters greater than 4.5 inches. Typically in the present state of the art continuous coiled tubing will be used as the inner tubing which enters the well itself inside the jointed riser to carry out the various intervention operations that are required.

There are a number of disadvantages to the use of a jointed riser. These are that the surface vessel has to be located and anchored accurately above the well head. This can be a very time consuming operation. It will be appreciated that in well intervention operations a large proportion of the cost arises from the hire charges, or lease charges, or cost of capital whatever the financial arrangement, of the expensive capital equipment, as well as the labor cost off-shore. The time spent carrying out the required operations has therefore a critical affect on costs. In addition to the task of accurately anchoring the surface vessel it is also necessary to include heave compensation systems to compensate for the movement of the relatively fixed riser and the surface vessel which will rise and fall with the swell of the sea.

OBJECTS OF THE INVENTION

An object of the invention is to provide a method and apparatus for ensuring positional consistency between a well head and a vessel without the need for an expensive heave compensation system on the vessel. It is also an object to provide an apparatus and method which ensure that there is no damage caused to the well head by bending moments applied by movement of the piping connecting it to the surface vessel.

Yet another object of the invention to enable well intervention operations to be carried out using smaller diameter coiled tubing as the riser instead of jointed tubing.

SUMMARY OF THE INVENTION

According to the invention there is provided a tube assembly which comprises a length of first continuous coiled outer tubing which is intended to be fixedly connected to a remote facility such a well head in which prior to deployment the continuous coiled outer tubing is installed in a first reel and the first reel includes a further second reel of a second continuous coiled tubing. In the case of the remote facility being an oil or gas well the first, outer tubing is a riser and the second, inner tubing is known as intervention tubing. The second continuous coiled tubing has a smaller diameter than the first continuous coiled tubing and it also has a greater length so that it can extend through the continuous coiled riser tubing down into the well to carry out the required operations.

According to the invention the continuous coiled riser tubing reel also includes an injector for the injection of the second continuous coiled tubing into the first continuous coiled tubing. The first continuous coiled tubing is connected to the injector at the end remote from the riser head arrangement. Preferably the second continuous coiled tubing is injected to the end of the first continuous coiled riser tubing and is connected with the tools or instruments contained in the riser head arrangement so that, when the riser assembly is deployed, the second continuous coiled tubing can be injected further into the well carrying the required tools or instruments to carry out the required operations.

The bending of continuous first coiled tubing, or riser tubing, in the deployed position automatically accounts for the ocean heave avoiding the requirement for a heave compensation system. It is therefore not necessary to anchor the surface vessel in an accurate position directly above the well head. On the contrary it may be advantageous to locate the vessel a certain distance from the well head in order to increase the length of the continuous coiled riser tubing required which will permit greater degrees of bending which provide greater natural compensation.

Thus the expensive operations of accurate location and anchoring as well as the capital intensive heave compensation systems are avoided by means of the invention.

BRIEF DESCRIPTION OF THE DRAWING

There is now described a detailed embodiment of the invention, in which the continuous coiled tube assembly is shown by way of example only as coiled riser tubing for oil or gas well intervention, with reference to the accompanying drawings in which.

SPECIFIC DESCRIPTION

Figure 1:
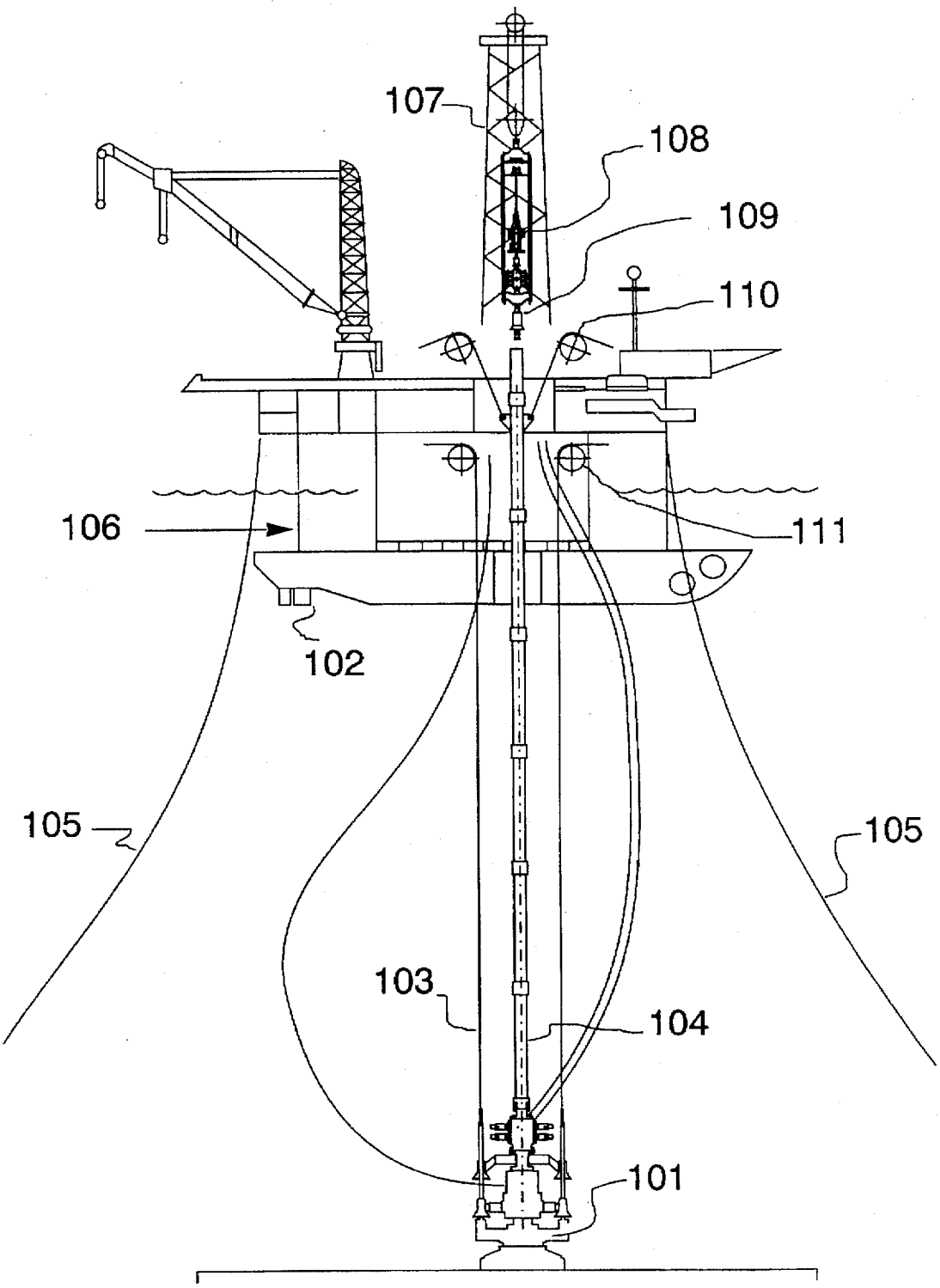
FIG. 1 is cross sectional view of the general arrangement of a riser assembly system according to the prior art.

In FIG. 1, an arrangement of a prior art well intervention system is shown. A specialized surface vessel 106 is located directly above the well head 101. The accurate location is provided by specialized powerful thrusters 102. The vessel is anchored in the desired position by means of chain anchors 105. By means of a derrick 107 a jointed riser 104 is connected between the well head 101 and the vessel 106. In order to accommodate the movement of the vessel 106 with respect to the riser a riser compensation system 110 is required. Guide lines 103 are also connected between the vessel 106 and the well head 101 and these also have a heave compensation system 111. The well intervention continuous coiled tubing 108 is then lowered into the riser with the required tools and equipment attached. The disadvantage with this system is that it can take a long time to locate and anchor the vessel accurately above the well head. Also the heave compensation equipment is very capital intensive.

Figure 2:
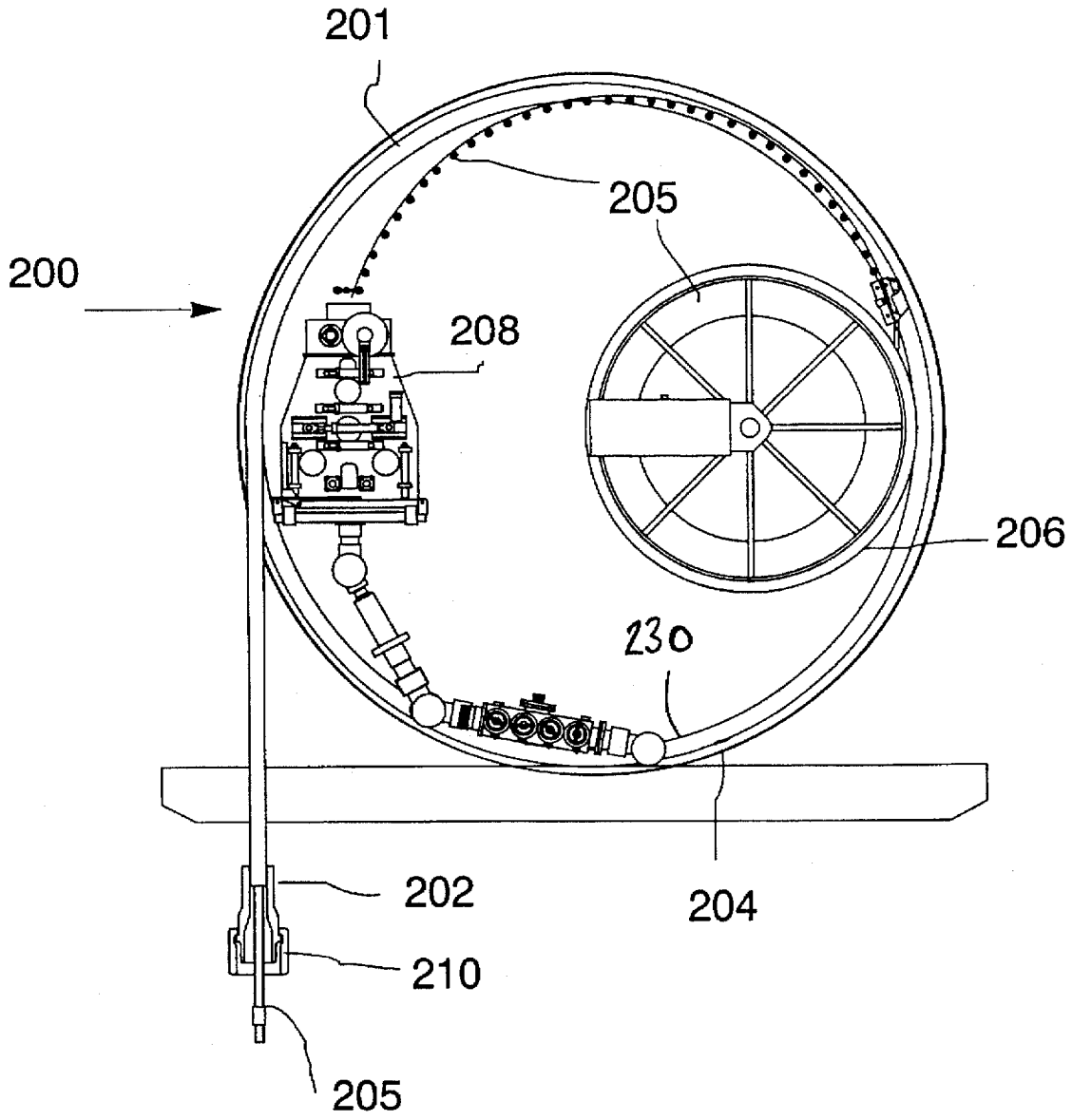
FIG. 2 is a cross sectional view of the continuous coiled riser and intervention tubing on the reels of an embodiment of the present invention.

The riser arrangement of the present invention will now be described which alleviates these disadvantages. Referring to FIG. 2 there is provided a riser assembly 200 which comprises a length of continuous coiled riser tubing 201 and a riser head arrangement 202 at one end which includes a riser 210 and is intended to be fixedly connected to the well head. Prior to deployment the continuous coiled riser tubing is installed on a first reel 204 and the first reel 204 includes a further second reel 206 of continuous coiled intervention tubing 205. The continuous coiled intervention tubing 205 has a smaller diameter than the continuous coiled riser tubing 201 and it also has a greater length so that it can extend through the continuous coiled riser tubing 201 down into the well to carry out the required operations.

The first reel 204 for the continuous coiled riser tubing 201 also includes an injector 208 for the injection of the continuous coiled intervention tubing 205 into the continuous coiled riser tubing 201. The continuous coiled riser tubing 201 is connected to the injector 208 at the end 230 remote from the riser head arrangement 202. Prior to deployment the continuous coiled intervention tubing 205 is injected into the end of the continuous coiled riser tubing 201 and is connected with the required tools or instruments 213, usually known as the tool string contained in the riser head arrangement 202 so that when the riser assembly 200 is deployed the continuous coiled intervention tubing 205 can be injected further into the well carrying the required tools or instruments (referred to as a tool string) 213 to carry out the required operations. The first riser tubing 201 is connected to the riser 210 which has a diameter large enough to accommodate the tool string 213. The riser head arrangement 202 also includes means for locating and securing itself on the well.

By this means it is possible to use continuous coiled tubing 201 as the riser. The bending of continuous coiled riser tubing 201 in the deployed position automatically accounts for the ocean heave avoiding the requirement for a heave compensation system. It is therefore also not necessary to anchor the surface vessel in an accurate position directly above the well head. On the contrary it may be advantageous to locate the vessel a certain distance from the well head in order to increase the length of the continuous coiled riser tubing 201 required which will permit greater degrees of bending which provide greater natural compensation.

Thus the expensive operations of accurate location and anchoring as well as the capital intensive heave compensation systems have been avoided by means of the invention.

Figure 3:
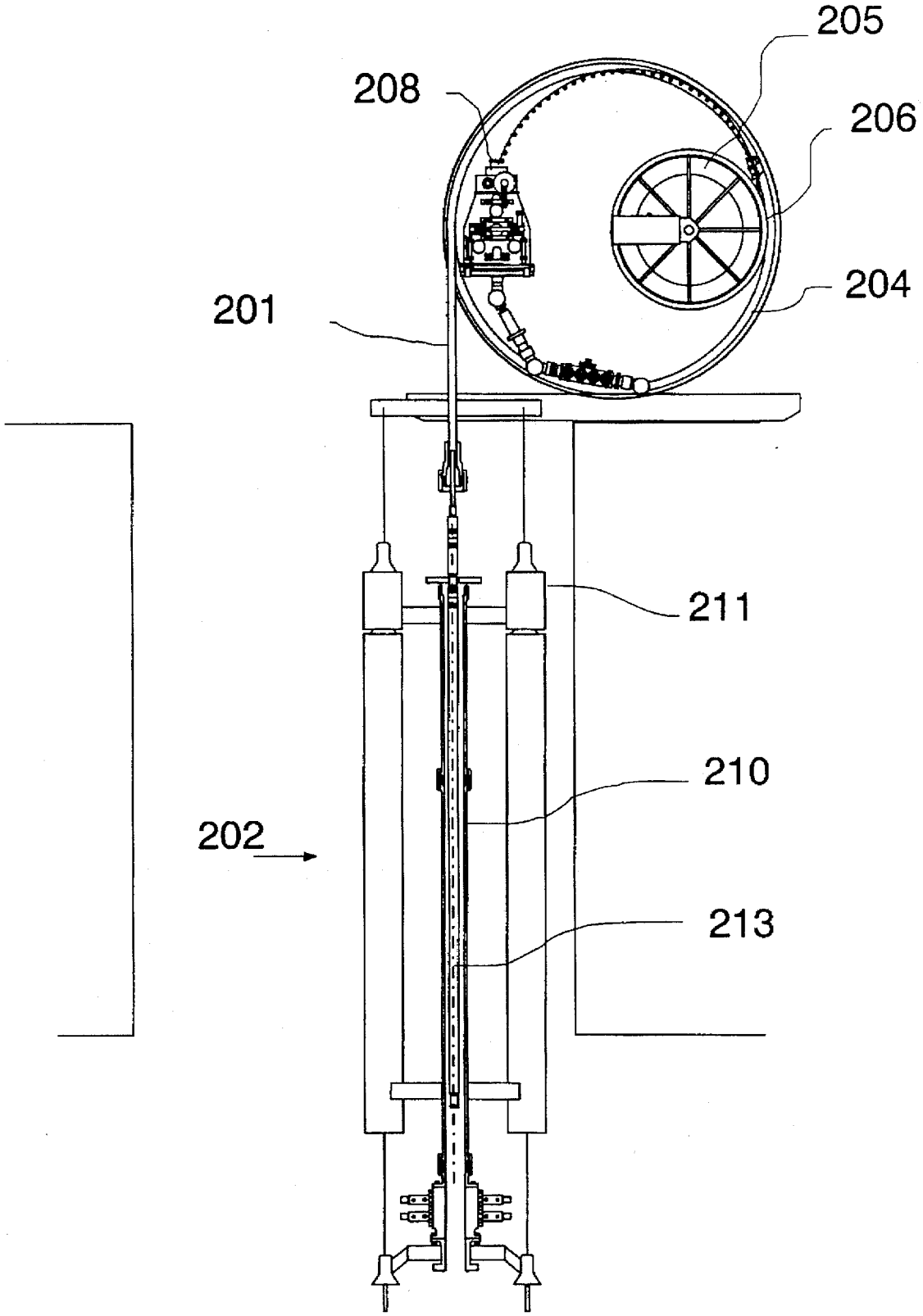
FIG. 3 is the view of the assembly of FIG. 2 showing the riser tubing connected to tools and equipment at its free end.

FIG. 3 shows the riser head arrangement 202 in greater detail including the tools and equipment 213 which are arranged in a tubular casing 210 of larger diameter than the riser tubing 201. The riser head arrangement 202 also comprises buoys 211 to enable it to be located to the well head. The riser head arrangement is connected to the free end of the riser tubing prior to lowering of the whole arrangement down to the well head.

Thus it will be appreciated that by means of the invention it has been established that it is not necessary for the required tools and equipment to be lowered down to the well through a fixed outer or riser tubing extending the whole distance from the vessel to the well head but instead the tools and equipment can be arranged in the a riser head arrangement and connected to the free end of the much narrower coiled continuous riser tubing of the invention and lowered to the well head by this means. By means of this breakthrough the use of continuous coiled tubing as the outer riser tubing is made possible which in turn enables the whole well intervention operation to be carried out at a much lower cost.

Figure 4:
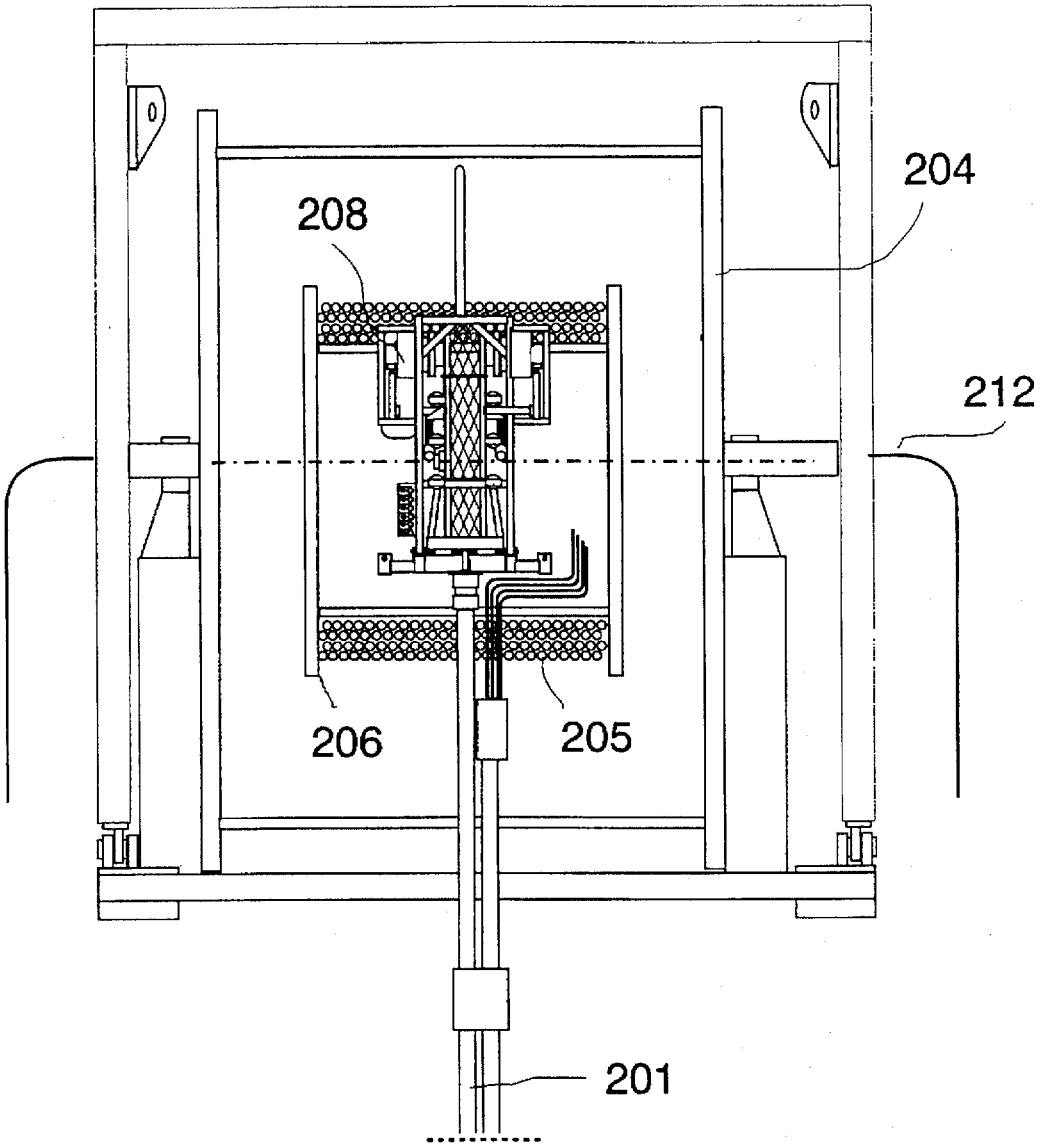
FIG. 4 is a cross sectional end view of the reels of FIG. 2.

FIG. 4 shows an end cross section of the reel 204 of the continuous coiled riser tubing 201. The reel 206 of the continuous coiled intervention tubing 205 is located inside the reel 204 for the convenient attachment of both of the continuous coiled tubings 201, 205 with the injector 208. It will be appreciated that it is possible to locate the reels side by side or in any other desired arrangement which allows for the bending required for the continuous coiled intervention tubing 205 to be injected into the continuous coiled riser tubing 201.

It will be appreciated that the riser assembly can be prepared ready for deployment conveniently while the vessel is sailing to the well head location. The continuous coiled intervention tubing 205 will be already injected into the continuous coiled riser tubing 201 as far as the assembly head 202 and the required tools and instruments will be engaged by the continuous coiled intervention tubing 201 ready for deployment within the well itself to carry out the desired operation. When the well-head location is reached the reel 204 unreels the continuous coiled riser tubing 201 to the well head. Rotary unions 212 at the axles of the reel 204 permit all services to the continuous coiled intervention tubing 205 to be active during the unreeling of the reel 204. When the unreeling is complete the continuous coiled riser tubing 201 is secured to the well head and the unwinding of reel 206 can commence which lowers the continuous coiled intervention tubing 205 into the well with the required tools and instruments already attached to carry out the required operations.

Figure 5:
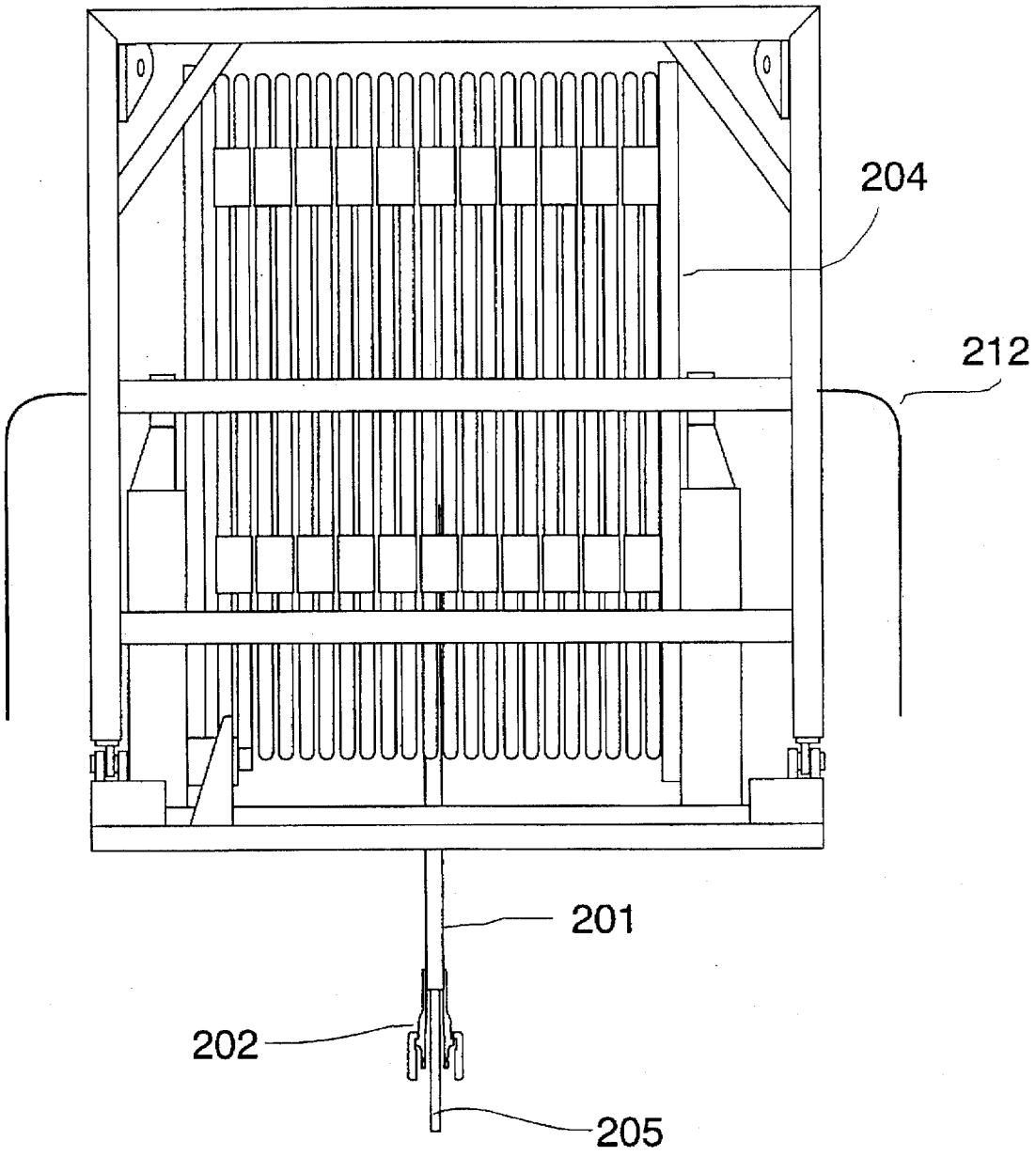
FIG. 5 is an end view of the reels of FIG. 2.

FIG. 5 shows an end view of the reel 204 in the unreeled state awaiting deployment.

Figure 6:
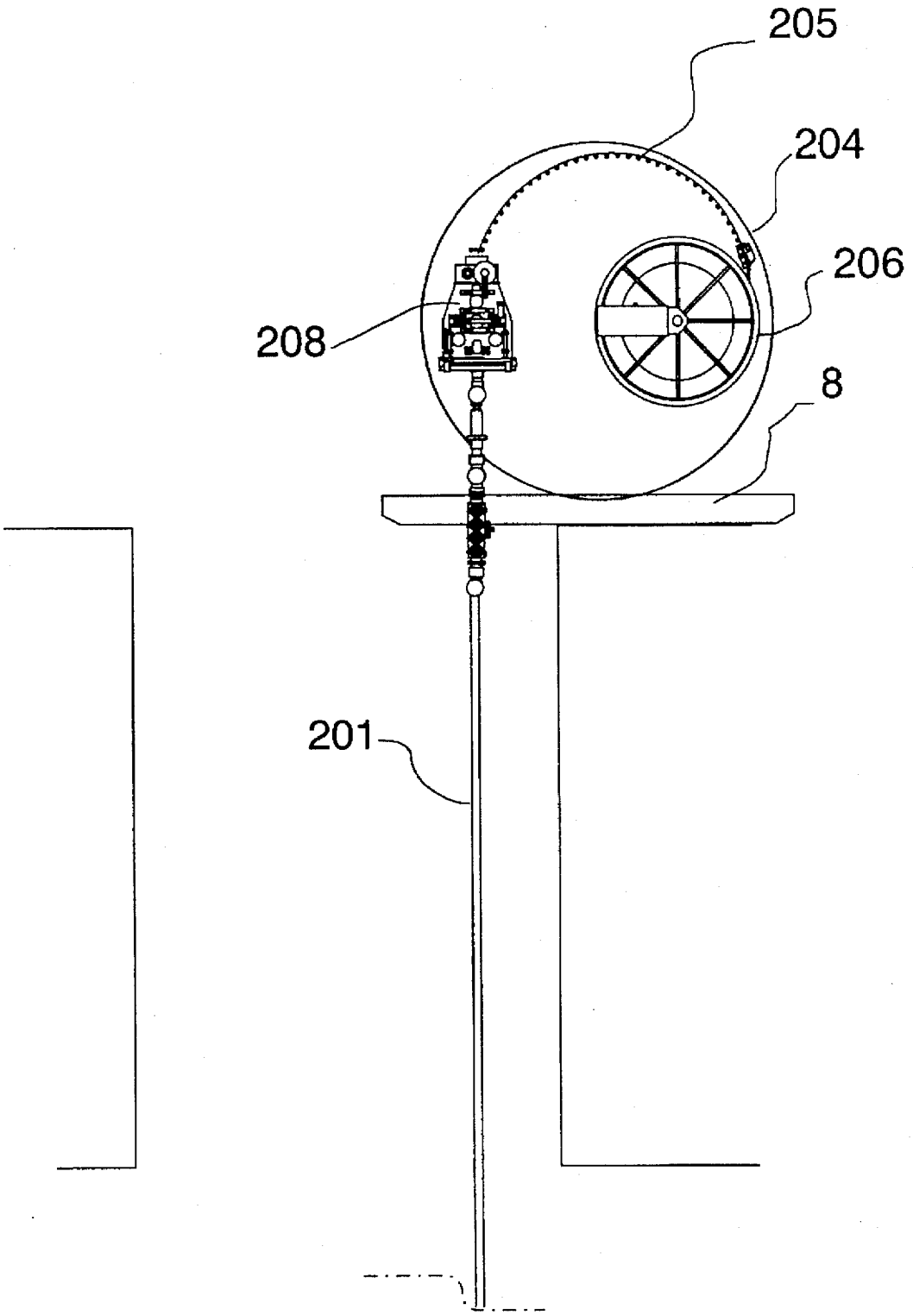
FIG. 6 is a cross section of the coiled tubing reel after lowering of the riser assembly to the well head.

FIG. 6 shows the continuous coiled riser tubing 201 and the riser head arrangement 202 on its end being lowered to the location of the well head.

Figure 7:
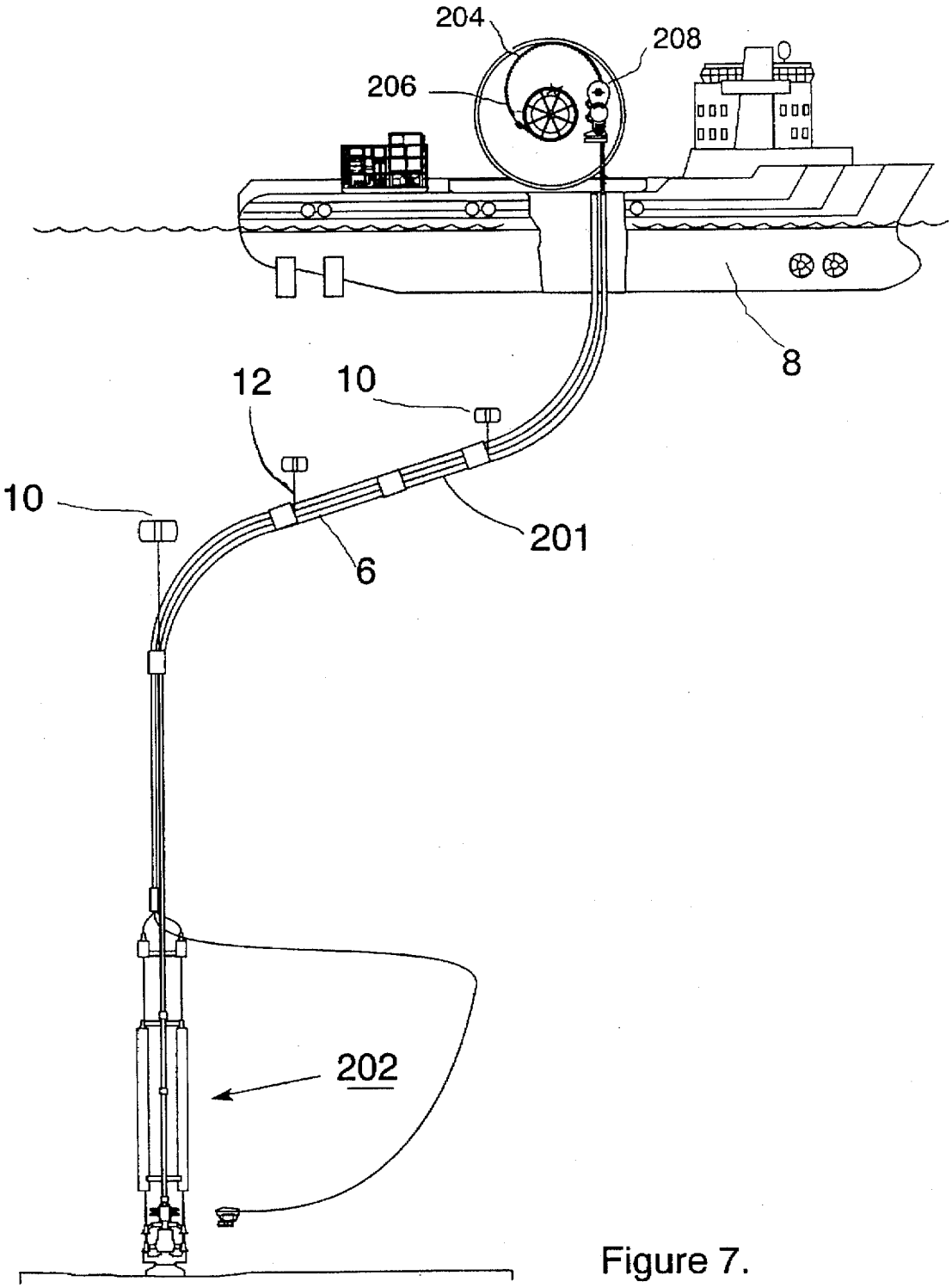
FIG. 7 is a cross section of the riser assembly, coiled tubing and surface vessel after connection of the riser assembly to the well head.

FIG. 7 shows the general arrangement of the riser assembly 200 in the deployed position. A number of support buoys 10 are provided each of which comprise a chamber which is capable of being evacuated and refilled. The support buoys 10 are connected to the riser head arrangement 1 and the continuous coiled riser tubing 201 by means of guide lines 12 at intermittent points along the continuous coiled riser tubing 201 between the riser head arrangement 1 and the vessel 8. By this means the profile of the coiled tubing can be controlled so that it provides an even incline which will permit the easy flow of the required equipment and instrumentation down to the well head. The continuous coiled riser tubing 201 is also made sufficiently long and allowed to bend with the movement of the heave of the sea or ocean which avoids the need for a heave compensation system on the vessel itself. The support buoys 10 are adjusted by means of evacuation and/or refilling to ensure the desired profile of the continuous coiled riser tubing 201.

Figure 8:
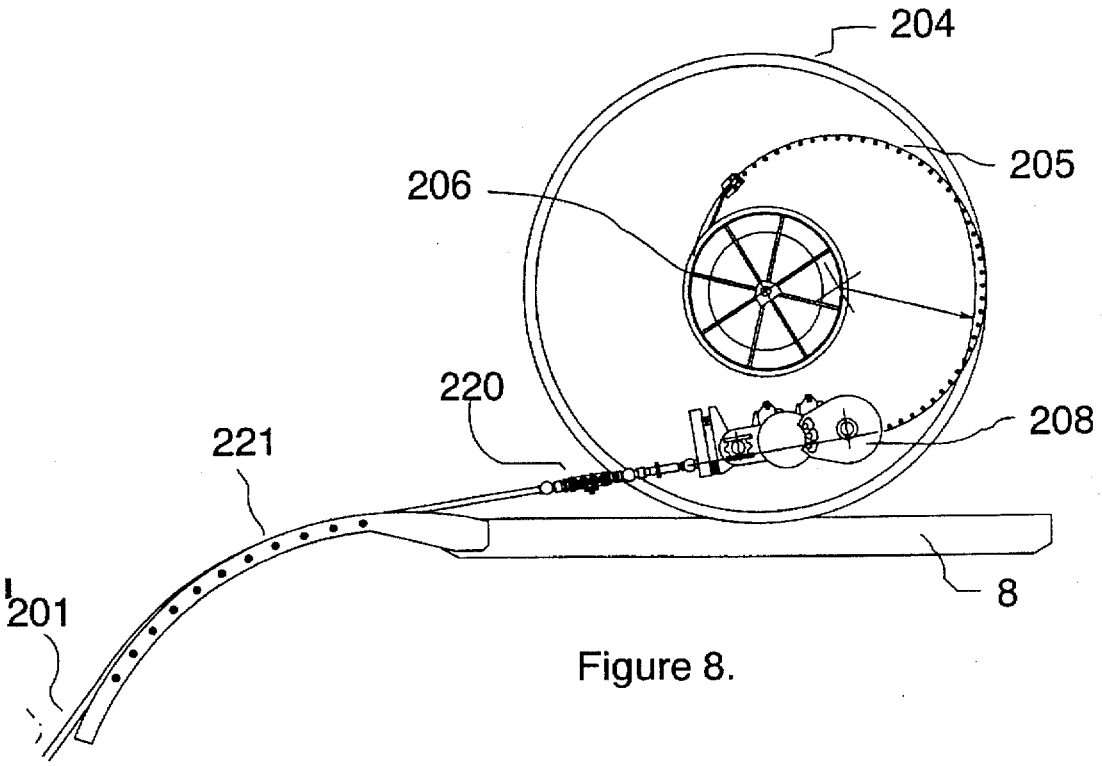
FIG. 8 is a cross sectional view of an alternative embodiment of the tube assembly of the present invention showing the stage of deployment.
Figure 9:
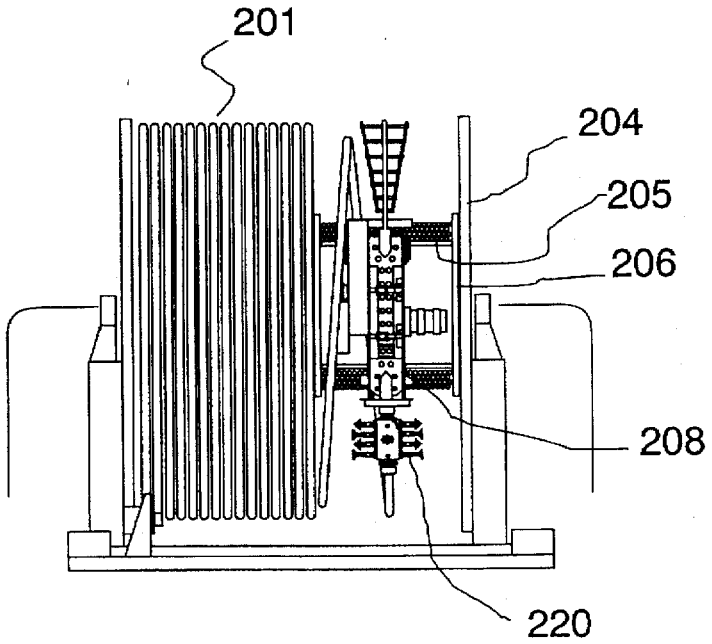
FIG. 9 is an end view of an alternative arrangement of the reels of the tube assembly of the invention.

FIGS. 8 and 9 show a further embodiment of the tube assembly being deployed from a vessel 8. The embodiment includes inner tubing 205 being injected into the outer tubing 201 by means of the injector 208. The arrangement also comprises blow out preventers 220 as well as a high pressure annular seal 222 with a knuckle joint 223 arranged between them. The blow out preventer 220 is located at the reel end of the outer tubing 201 but it will be appreciated that it could also be located at the opposite end of the outer tubing 201 before the connection to the riser 210. The outer tubing 201 is deployed from the vessel and lowered down into the water over an arch 221 of the vessel 8.

The above embodiments describes the invention as applied to coiled riser tubing by way of example only and it will be appreciated by the person skilled in the art that the invention could just as easily be applied to a joined tube system or to any tube assembly requiring the use of the essential features of the invention.

What is claimed is:

1. A tube assembly for servicing a well head, comprising:

a length of continuous first coiled tubing provided with means for fixed connection of one end of said first coiled tubing to a well head of oil or gas reservoir;

a first reel receiving said first coiled tubing;

a second reel of a continuous second coiled tubing on said first reel; and an injector for the injection of the second continuous coiled tubing into the continuous first coiled tubing.

2. The tube assembly according to claim 1 wherein the continuous first coiled tubing is connected to the injector at an opposite end of said first coiled tubing.

3. The tube assembly according to claim 1 wherein the second coiled tubing is connected to a tool string having a diameter greater than an internal diameter of the first coiled tubing.

4. The tube assembly according to claim 3 wherein the second coiled tubing is connected to a riser having an internal diameter greater than an outside diameter of the tool string.

5. The tube assembly according to claim 1, further comprising at least two support buoys connected by guide lines to the first coiled tubing at intermittent points along its length.

6. The tube assembly according to claim 1 wherein the second coiled tubing is a well intervention tubing.

7. The tube assembly according to claim 1 wherein the second coiled tubing has a greater length than the first coiled tubing so that it can extend through the continuous coiled outer tubing down into a well below the well head.

8. The tube assembly according to claim 1 wherein the second coiled tubing has a smaller diameter than the first coiled tubing so that the second coiled tubing can be installed inside the first coiled tubing.

9. A tube assembly for servicing a well head, comprising:

a length of continuous first coiled tubing provided with means for fixed connection of one end of said first coiled tubing to a well head of oil or gas reservoir;

a first reel receiving said first coiled tubing;

a second reel of a continuous second coiled tubing on said first reel;

a tool string connected to said second coiled tubing and having a diameter greater than an internal diameter of the first coiled tubing; and a riser connected to said first coiled tubing having an internal diameter greater than an outside diameter of said tool string.

10. The tube assembly defined in claim 9, further comprising at least two support buoys connected by guide lines to the first coiled tubing at intermittent points along its length.

11. A tube assembly for servicing a well head, comprising:

a length of continuous first coiled tubing provided with means for fixed connection of one end of said first coiled tubing to a well head of oil or gas reservoir;

a first reel receiving said first coiled tubing;

a second reel of a continuous second coiled tubing on said first reel; and at least two support buoys connected by guide lines to the first coil tubing at intermittent points along its length.

* * * * *